US008025769B2

(12) United States Patent
Wiker et al.

(10) Patent No.: US 8,025,769 B2
(45) Date of Patent: Sep. 27, 2011

(54) HIGHLY ACOUSTICAL, WET-FORMED SUBSTRATE

(75) Inventors: Anthony L. Wiker, Lancaster, PA (US); Robert C. Garman, Millersville, PA (US)

(73) Assignee: AWI Licensing Company, Wilmington, DE (US)

( * ) Notice: Subject to any disclaimer, the term of this patent is extended or adjusted under 35 U.S.C. 154(b) by 265 days.

(21) Appl. No.: 12/231,151

(22) Filed: Aug. 29, 2008

(65) Prior Publication Data

US 2009/0056898 A1 Mar. 5, 2009

Related U.S. Application Data

(60) Provisional application No. 60/966,607, filed on Aug. 29, 2007.

(51) Int. Cl.
*D21F 13/00* (2006.01)

(52) U.S. Cl. ..... 162/218

(58) Field of Classification Search ..... 162/218; 428/317.9

See application file for complete search history.

(56) References Cited

U.S. PATENT DOCUMENTS 6,596,389 B1 * 7/2003 Hallett et al. ..... 428/317.9

* cited by examiner

*Primary Examiner* — Mark Halpern

(57) ABSTRACT

This invention is an acoustic fiber-based substrate composed primarily of insulation-type spun fibers or blends of such fibers and wheel spun fibers. The fibers are bound with a water-dispersible latex binder, or an agri-binder such as starch in conjunction with cellulose fiber. The insulation-type spun fibers can be first quality virgin, post-industrial waste-stream or post-consumer waste stream fiber. The substrate is wet-formed from a very dilute aqueous dispersion of ingredients onto a mesh forming screen, as on a Fourdrinier paper machine. By virtue of the insulation-type spun fiber dimensions, morphology and orientation: very low density wet-mats can be formed from a sufficiently dilute suspension. With respect to other wet-formed substrates, the invention is much lower in density and more highly porous, and, thus, the substrate is highly absorbing, exhibiting noise reduction coefficients, NRC values of about 0.80 or greater. Such NRC values have only been achieved with dry-formed, or air-laid processes in which the fiber are bound with formaldehyde emitting reactive resins.

10 Claims, 10 Drawing Sheets

HIGHLY ACOUSTICAL, WET-FORMED SUBSTRATE

CROSS REFERENCE TO RELATED APPLICATION

This application claims the benefit under 35 U.S.C. §119 (e) of U.S. provisional application Ser. No. 60/966,607, filed Aug. 29, 2007.

BACKGROUND OF THE INVENTION

The invention relates primarily to the field of acoustical and/or insular building materials, and, more specifically, to such building materials made by wet-forming techniques.

Conventional fiber-based acoustic substrates, such as acoustical ceiling, wall and duct board panels, can either be wet or dry-formed. Acoustic substrates formed by wet-forming techniques generally incorporate short, fine diameter fibers in the formulation. These fibers are compacted by the gravity force of dewatering. It is well settled in the art that compaction, or packing, of fibers has an inverse impact on acoustical absorption performance.

Additionally, conventional wet-formed acoustic substrate formulations require a significant amount of cellulose fiber, e.g. paper fiber, to be incorporated into the substrate formulation in order to achieve sufficient wet-web strength for the material to successfully flow through a wet-form manufacturing process. Due to its chemistry, affinity for water and tendency to hydrogen bond both with water and itself, cellulose fiber has a densifying impact on the wet-formed fiber compositions, which, in turn, limits the level of acoustical absorption that can be achieved by the material. For at least the above reasons, conventional wisdom is that wet-formed fiber based substrates are typically limited in sound absorption capability.

One conventional attempt to overcome this negative impact on acoustic performance has been to add low density foamed materials to the formulation. Though these low density foamed materials provide bulk and thickness to the product which promotes acoustic performance, they fill up the pores of the material, which, in turn, limits the level of acoustical absorption that can be achieved by the material. Presently, the most sound-absorbing wet-formed materials have a porosity of about 90% which, in turn, provides a noise reduction coefficient (NRC) value of approximately 0.75. One widely used low density foamed material is perlite. In addition to the previously mentioned limitation it has on acoustics, perlite, because of its fine cellular pore structure and hydrophilic capillarity, is also difficult and slow to dry.

Additionally, current wet-formed fiber-based acoustic structures are substantially, if not entirely composed of wheel spun fibers, such as mineral fibers, which results in substrates that are generally inflexible, unconformable and high in density, i.e. 12-16 lb/ft$^3$. These substrates which are typically ½ inch to 1 inch thick are friable and break easily. Furthermore, the wet-formed substrates do not absorb impact energy and are easily dented and deformed during handling and/or installation. This is a particular issue with fiber-based acoustical substrates as they posses densities low enough to achieve the limited sound absorption characteristics described above.

At the same time, conventional dry-formed acoustic fiber-based substrates are less dense and highly acoustical and are capable of achieving NRC values typically in the range of 0.80-1.00. Unfortunately, the types of binders compatible with the dry-forming process, including low cost phenol-formaldehyde thermosetting resins and other more expensive reactive thermosetting resins, emit carcinogenic formaldehyde as the resin cures. In addition, these dry-formed products are often inhomogeneous and poorly formed. Further, these resins have associated process and environmental problems. For example, the resins deposit on process equipment, requiring frequent shut-downs and cleaning of the equipment. Phenolic and other thermoset resins used to bind such substrates also do not allow for the molding and embossing of the substrate as the cured binder does not soften and flow when subjected to heat or steam.

Accordingly, there is a need for a product which; delivers high acoustical performance heretofore achieved only in dry-formed materials and which does not possess the aforementioned drawbacks of conventional dry-formed materials.

SUMMARY OF THE INVENTION

The invention is a new manifestation of fiber-based acoustic substrates. More specifically, the invention is an acoustical fiber-based substrate which includes a blend of rotary spun fibers and wheel spun fibers, wherein the ratio of rotary spun fibers to wheel spun fibers is in the range of about 0.13:1 and about 3:1. The substrate also includes a binder which contains no formaldehyde emitting reactive resin. A substrate having a thickness of ½ inch to 1 inch exhibits an NRC value of at least 0.80 which has not been heretofore achieved in a substrate of this thickness which has been formed via a wet-forming process.

The invention also includes a method of producing a highly acoustical, wet-formed substrate. The method includes the steps of: dispersing rotary spun fibers in an aqueous slurry, the slurry having a dispersion consistency of up to 3.5% by weight, and preferably 2% or lower; mixing the aqueous slurry to achieve a homogeneous aqueous mix; dispensing the homogeneous aqueous mix onto a mesh forming screen conveyor; dewatering the homogeneous aqueous mix to form a wet mat; and drying the wet mat to form an acoustical substrate.

By virtue of the dimensions, morphology and orientation of rotary spun fibers, a substrate can be formed from a very dilute, i.e. low consistency, aqueous dispersion. A dilute aqueous dispersion is fundamental to providing a processable aqueous mix. In turn, an acoustic fiber-based substrate that is highly acoustic, well formed and homogeneous can be provided via a wet-forming process.

In comparison to conventional wet-formed fiber-based substrates, the substrate of the invention is much lower in density and more highly porous as the rotary spun fibers provide the bulk volume and structural integrity to resist compression and densification in the forming process, particularly in the previously mentioned dewatering step.

More specifically, the highest porosity heretofore achieved in wet-formed mineral fiber tiles is 89%, yielding an NRC value of about 0.75. In contrast, the present glass fiber acoustical panels have a porosity value in the range from about 93% to about 97% and are able to achieve NRC values in the range from about 0.80 to 1.00. Furthermore, the rotary spun fibers add significant manufacturing wet-web strength and bulk to the structure heretofore not achieved without the incorporation of a low density foamed material into the formulation. Moreover, the present invention provides a heretofore unachievable wet-formed structure which is lighter in weight, more elastic, compressible and forgiving of the force exerted upon it in handling and installation.

Additionally, relative to phenolic or acrylic bound, dry-laid, high porosity mineral fiber or fiberglass products, the fibrous wet-formed substrate of the invention is comparable in acoustical performance, yet the formation quality is substantially better; more uniform in density, homogeneity and strength. Further, the present invention overcomes the shortcomings of conventional dry-formed substrate as the substrate can be readily molded and embossed with heat alone or with heat and steam.

DETAILED DESCRIPTION OF THE INVENTION

The term "wet-formed substrate" refers herein to a substrate which has been formed via a wet-forming technique. In addition, the term "rotary spun fibers" refers herein to fibers which have been extruded through an orifice.

A conventional wet-forming technique includes dispersing fibers an aqueous slurry above 3.5% solids consistency in a mix chest. Large impellers are employed to keep the fibers dispersed and render the aqueous slurry a homogenous aqueous mix. A typical aqueous slurry formulation includes approximately: 60% wheel spun fibers, 10% cellulose fiber; 25% perlite; and 5% binder (latex or starch). The aqueous slurry is subsequently pumped to the head-box of a Fourdrinier, or Oliver-type forming machine, and onto a mesh forming screen conveyor. The aqueous slurry is then dewatered, such as by free drainage. After free drainage, water can further be removed with application of vacuum and/or compression. The wet material is then cut into individual mats with high pressure water jets and the mats are loaded onto a conveyor convection dryer where they are heated until dry. The dried mats are trimmed, painted and finished into decorative acoustical substrates.

The present invention can be formed using the same or similar wet-forming technique described above. However, the present invention utilizes a consistency dispersion and a formulation which has not been heretofore utilized in a wet-forming process. More specifically, a significantly lower dispersion consistency and the substitution of rotary spun fibers are fundamental to providing a processable aqueous mix, and, ultimately, a wet-formed substrate having the desired parameters. A conventional example of rotary spun fibers is fiberglass, whereas an example of non-conventional rotary spun fibers would be the Bio-Mineral wool available from OWA (Odenwald Faserplattenwerk GmbH).

Figure 1:
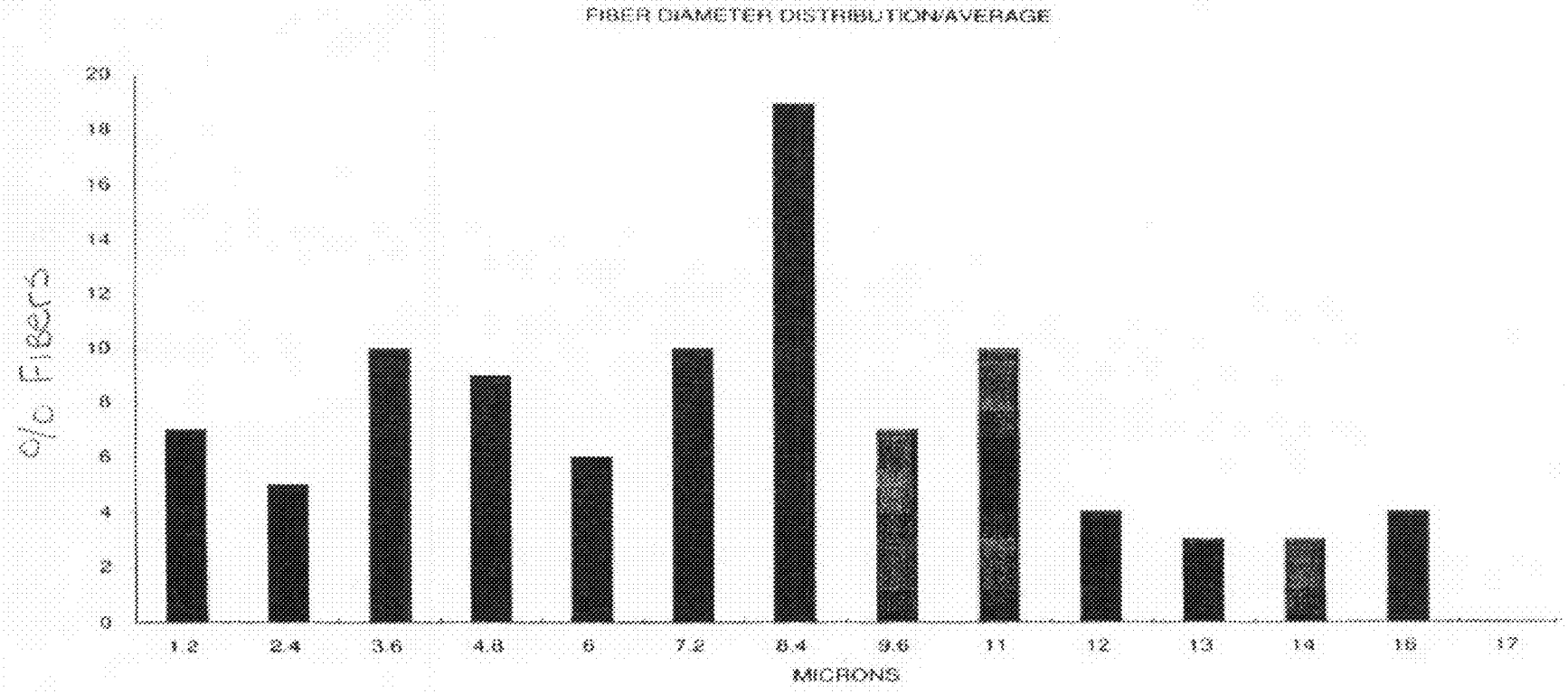
FIG. 1 is a chart illustrating fiber diameter distribution for slag alumina-silicate mineral fiber.
Figure 2:
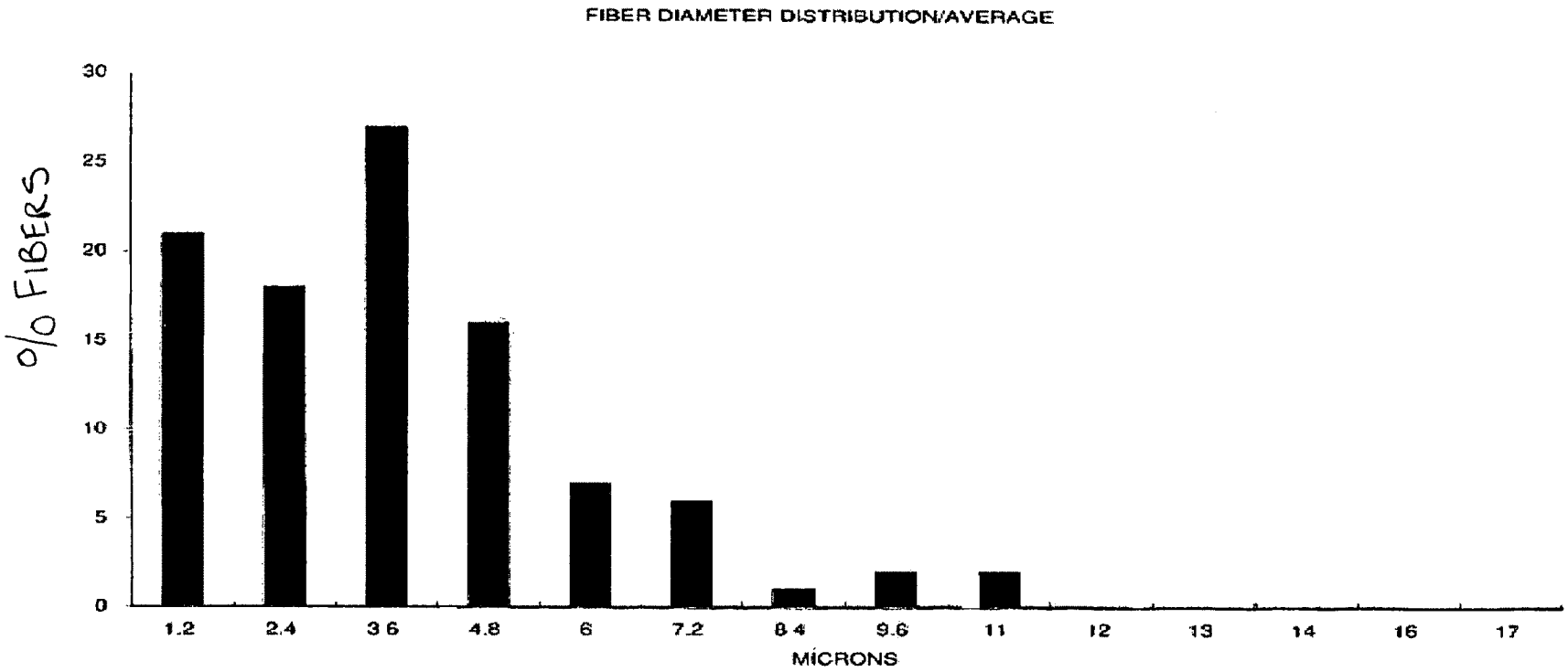
FIG. 2 is a chart illustrating fiber diameter distribution for C-type fiberglass.

FIGS. 1 and 2 as well as Table 1 below, illustrate the substantial dimensional differences between rotary spun fiber and wheel spun fiber. For purposes of illustration, data for wheel spun mineral wool and rotary spun fiberglass are displayed.

TABLE 1

| Fiber | Diameter (microns) | Length (mm) Short Fraction (weighted avg.) | Typical Long Fiber (mm) | Longest Fibers (mm) |
|---|---|---|---|---|
| Wheel spun mineral wool | 4 | 0.8 | — | — |
| Rotary spun fiberglass (c-type) | 5.8-6.2 | 1.2-1.4 | 6.4-6.8 | 10-25 |

The chart in FIG. 1 illustrates a typical fiber diameter distribution for slag alumina-silicate mineral fiber which is a wheel spun type fiber. The chart in FIG. 2 illustrates a typical fiber diameter distribution for C-type fiberglass which is a rotary spun type fiber. As shown in FIG. 2, a majority of the rotary spun fibers have a diameter of greater than 5 microns.

Figure 3:
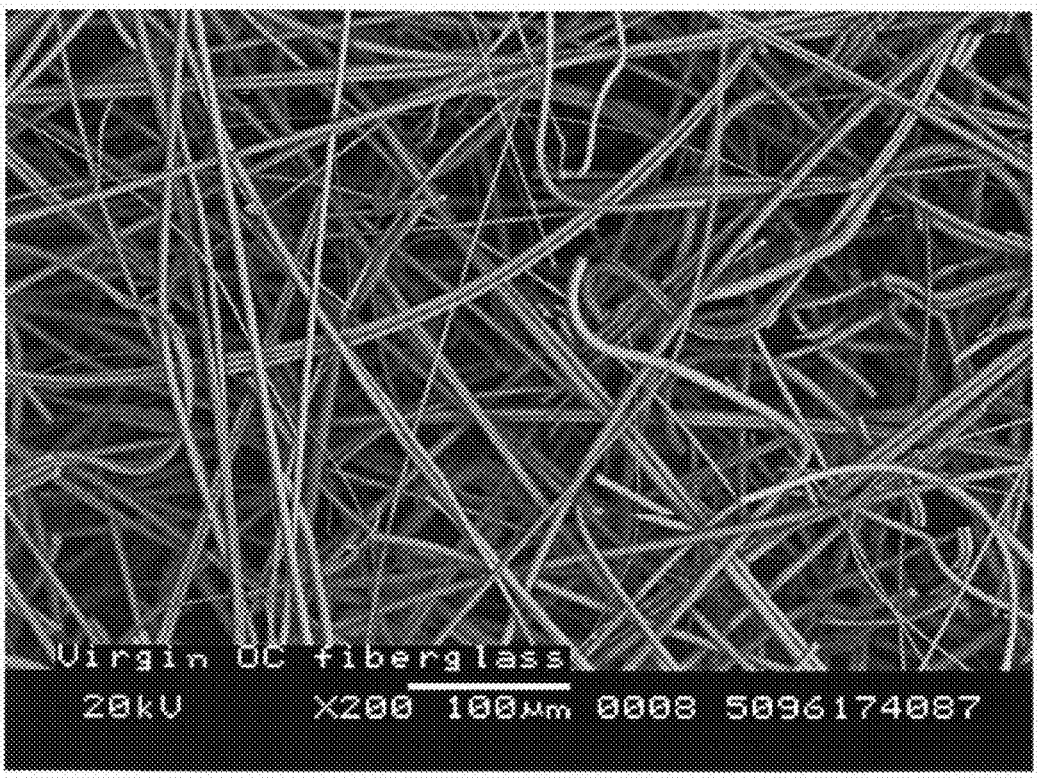
FIG. 3 is a Scanning Electron Microscope (SEM) photograph of rotary spun fibers.

Along with the dimensional aspects of rotary spun fibers, the morphology and orientation that results from the spinning process are likewise fundamental to the tremendous bulk and volume that the fibers can render to the substrate. As the SEM micrograph of FIG. 3 clearly shows, there are significant numbers of curved and curly fibers and longitudinal multi-fiber bundles. These features contribute z-directional structure to non woven structures, and the structural integrity to resist compression and densification in the forming process, particularly the dewatering steps of the wet-forming process. Hence, low density highly porous acoustical structures. If reclaimed post-industrial or post-consumer rotary spun fibers from insulation, duct-board or other products are incorporated in a wet-formed product, bound domains or bundles of the recovered material will also provide bulk volume and resistance to compression. It is advantageous to avoid breakdown of these domains in the dispersion and forming processes of the new product.

Table 2 below provides further data regarding rotary spun fiber substitution for wheel spun fiber. The densities of each were measured, and the acoustical absorption of each over the range of 125-5000 Hz was measured. The % porosity, the 4-frequency average absorption, (4FAvg) and the noise reduction coefficient, (NRC) were calculated for each material. The 4FAvg is the average of the absorptions measured at 250, 500, 1000 and 2000 Hz and is well understood in the art of acoustical fiber-based substrates.

TABLE 2

| Variation | % Rotary Spun Fiberglass (FG) | % Wheel Spun Mineral Wool (MW) | Ratio FG/MW | % FG Substitution on Wool | Basis Weight (lb/ft$^2$) | Th. (in) | Density (lb/ft$^3$) | % Porosity | 4FAvg | NRC Value |
|---|---|---|---|---|---|---|---|---|---|---|
| 1 | 89 | 0 | / | 100.00 | 0.33 | 0.83 | 4.77 | 97 | 0.925 | 0.95 |
| 2 | 66.75 | 22.25 | 3.0 | 75.00 | 0.38 | 1.03 | 4.45 | 97 | 0.915 | 0.90 |
| 3 | 44.5 | 44.5 | 1.0 | 50.00 | 0.346 | 0.82 | 5.313 | 96 | 0.887 | 0.90 |
| 4 | 10 | 79 | 0.13 | 11.24 | 0.6 | 0.61 | 8.64 | 94.95 | 0.875 | 0.90 |
| 5 | 25 | 64 | 0.39 | 28.09 | 0.61 | 1 | 7.2 | 95.72 | 0.91 | 0.90 |
| 6 | 17.5 | 71.5 | 0.24 | 19.66 | 0.69 | 0.818 | 10.12 | 93.7 | 0.81 | 0.80 |
| 7 | 25 | 64 | 0.39 | 28.09 | 0.7 | 0.816 | 10.29 | 94.1 | 0.795 | 0.80 |
| 8 | 22.25 | 66.75 | 0.33 | 25.00 | 0.64 | 0.767 | 9.98 | 93.8 | 0.798 | 0.80 |
| 9 | 1.5 | 87.5 | 0.02 | 1.69 | 0.793 | 0.696 | 13.67 | 91.4 | 0.697 | 0.70 |
| 10 | 1 | 99 | 0.01 | 1.12 | 0.645 | 0.575 | 13.47 | 91.48 | 0.692 | 0.70 |
| 11 | 1 | 99 | 0.01 | 1.12 | 0.797 | 0.681 | 13.51 | 91.48 | 0.71 | 0.70 |

All materials bound with 6% starch/5% pulped newsprint.

Figure 4:
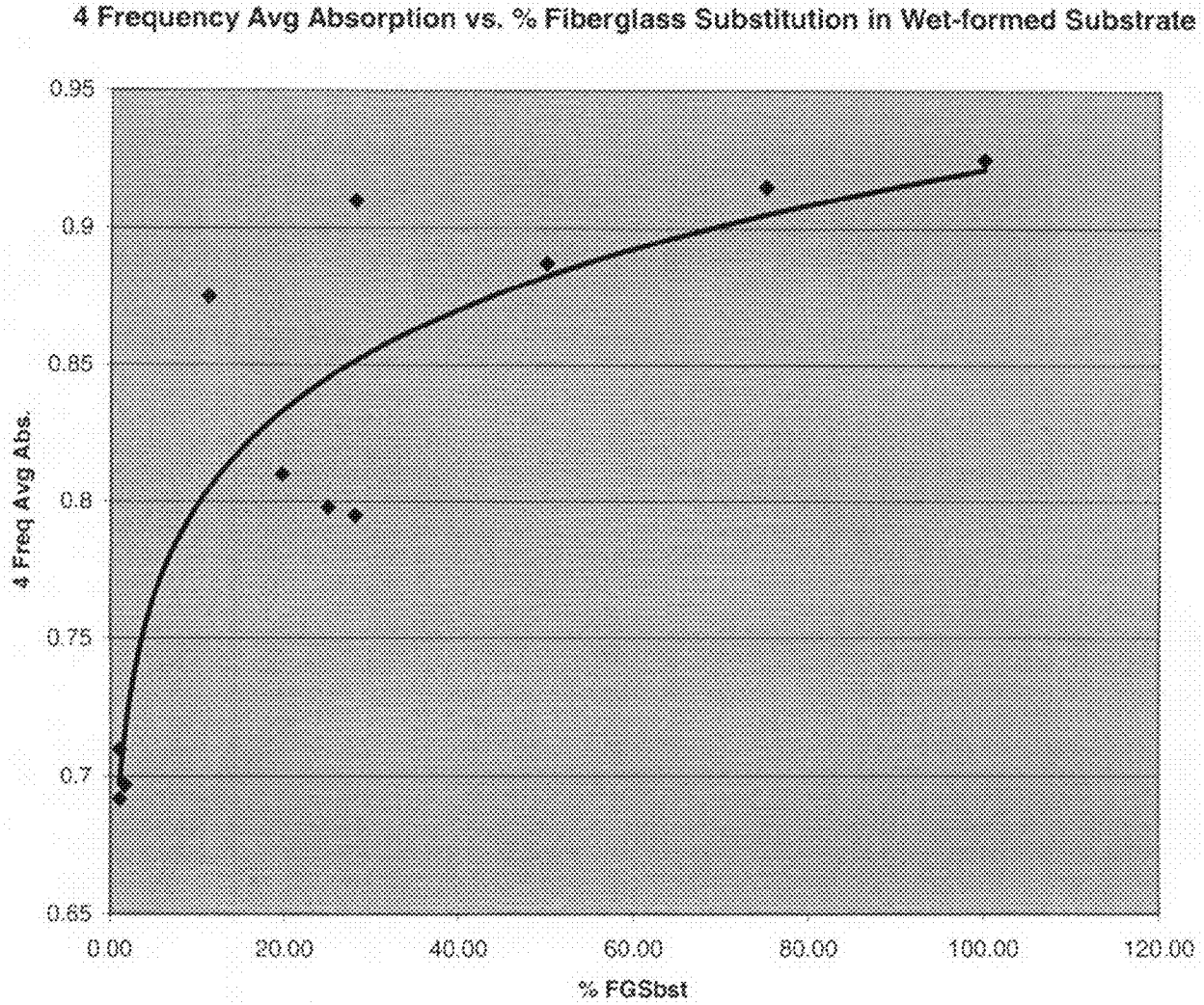
FIG. 4 is a chart illustrating the impact of increased spun fiber substitution on acoustical absorption.
Figure 5:
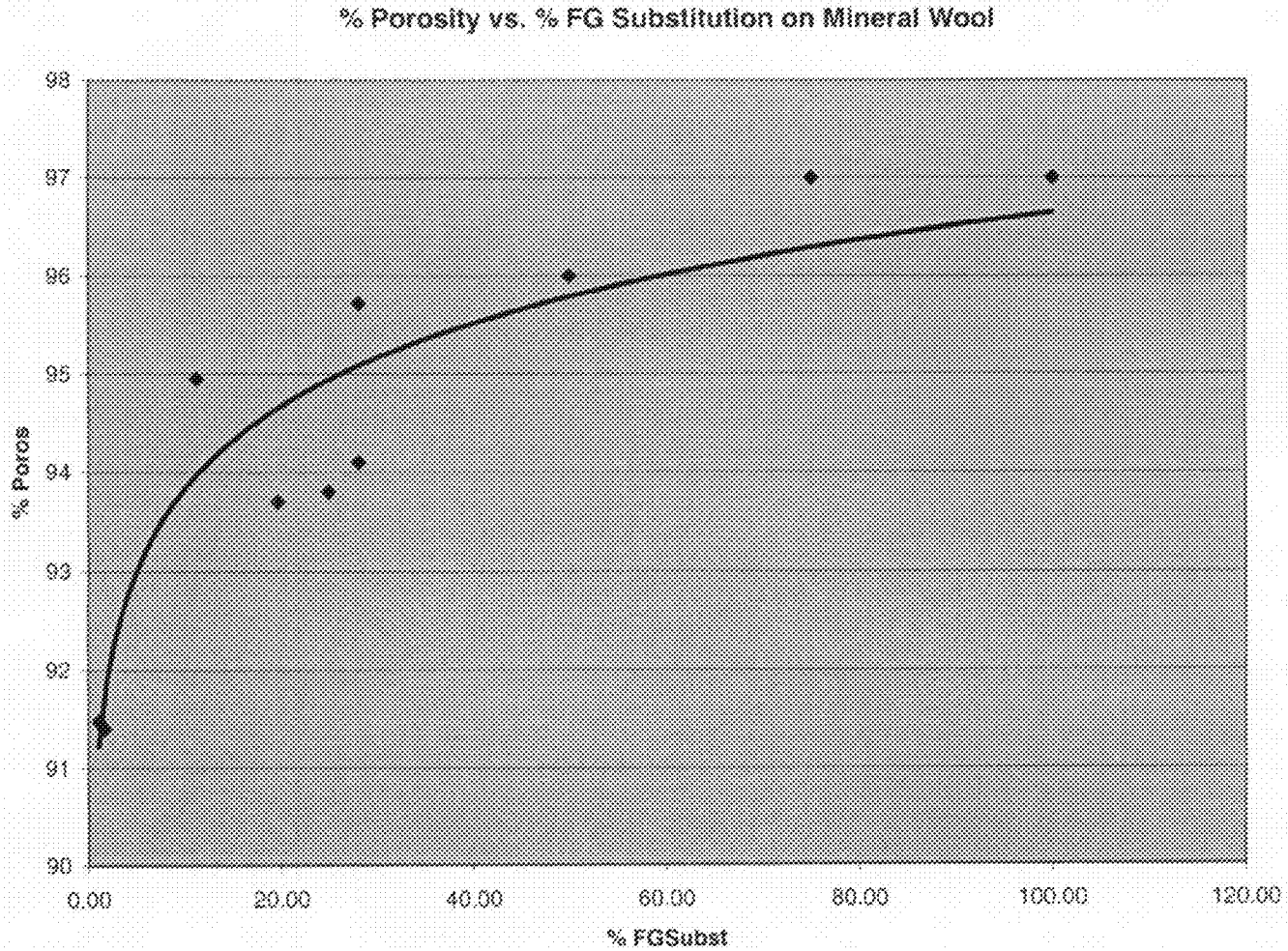
FIG. 5 is a chart illustrating the impact of increased spun fiber substitution on porosity.
Figure 6:
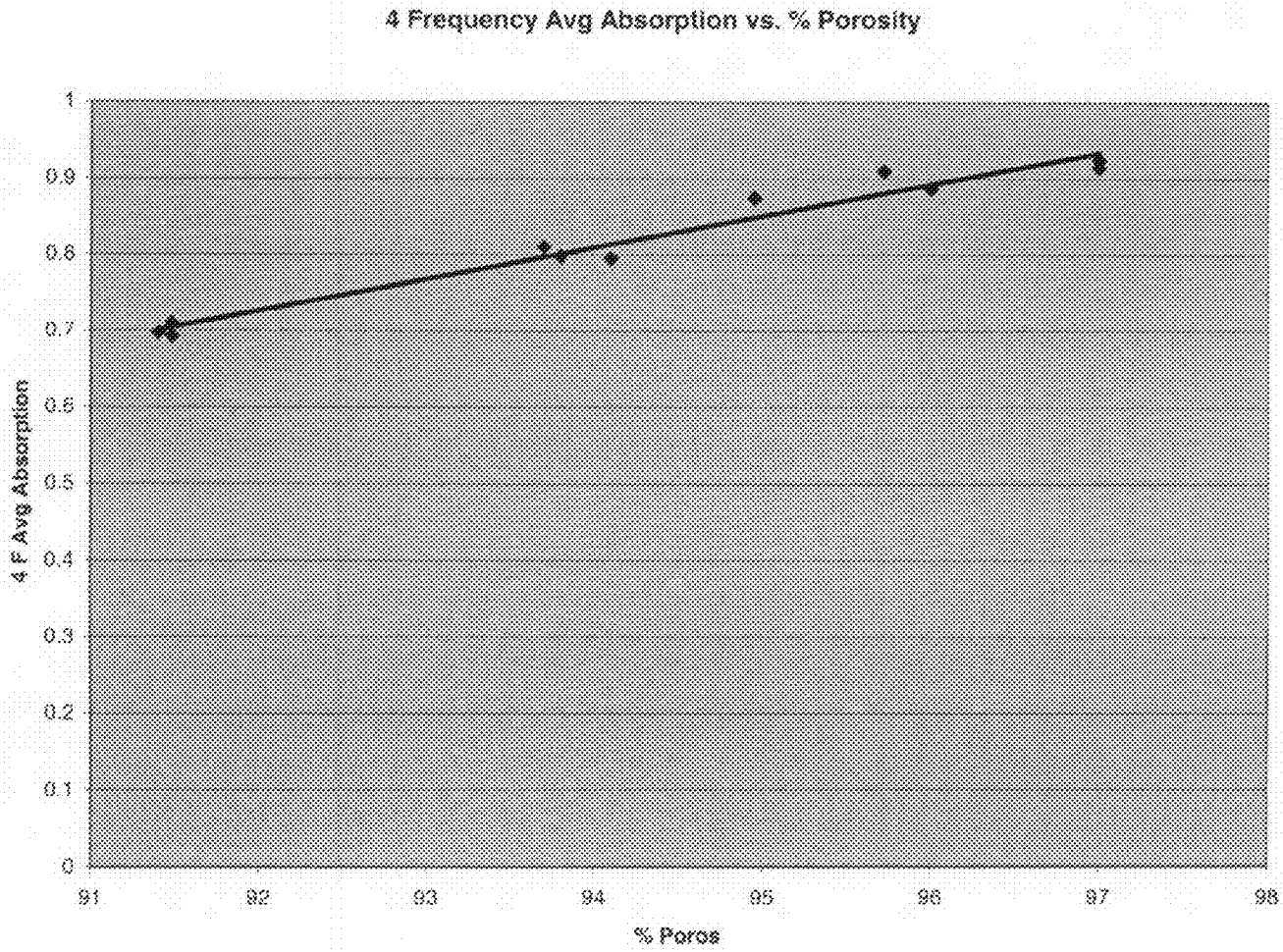
FIG. 6 is a chart illustrating the linear relationship between porosity and acoustical absorption.

The graphs contained in FIGS. 4-6 illustrate the impact of increased fiberglass proportion on acoustical absorption and % porosity and the clear linear relationship between % porosity and acoustical absorption. More specifically, FIG. 4 contains a chart illustrating the impact of increased spun fiber substitution on acoustical absorption. FIG. 5 contains a chart illustrating the impact of increased spun fiber substitution on porosity. FIG. 6 contains a chart illustrating the linear relationship between porosity and acoustical absorption.

The following is further illustration of the importance of dispersion consistency. Several adjustments or adaptations to the acoustical substrate wet-forming process were made in order to manufacture the invention. Low consistency dispersion of the rotary spun fibers is essential to forming a satisfactory, highly porous product of optimal strength and rigidity. While many wet-formed products are formed from dilute suspensions (e.g. paper, fiberglass scrim and gaskets), acoustical fiber-based substrates are most often formed from an aqueous slurry in the consistency range of 3.5-5%. This is in order to deliver the basis weights required for board thickness at economical line-speeds. For the instant invention, a lower consistency is required to insure adequate dispersion of the long rotary spun fibers and to avoid having the fiber fold on itself, i.e. modulate, which, in turn, would undermine the strength, integrity and acoustical performance of the material. As shown in the examples below, dispersion consistencies less than or equal to 2% can be utilized.

A hand-sheet study of rotary spun fiber substitution and forming consistency and their effect on porosity, strength and rigidity of the material was performed. The type of rotary spun fiber utilized for the hand-sheet study was fiberglass. As illustrated in Table 3, fiberglass was substituted for wheel spun mineral wool in aqueous slurry formulations 1-3 at the levels of 10%, 17.5% and 25% respectively.

TABLE 3

| | Formula (wt %) | | |
|---|---|---|---|
| | #1 | #2 | #3 |
| % Starch | 6 | 6 | 6 |
| % Paper | 5 | 5 | 5 |
| % Fiberglass | 8.9 | 15.58 | 22.25 |
| % Mineral Wool | 80.1 | 73.42 | 66.75 |

The hand-sheet basis weight was held constant at 0.80 lb/ft2. Material of each formula was formed at each of three dispersion consistencies, namely 1%, 2% and 3%.

Figure 7:
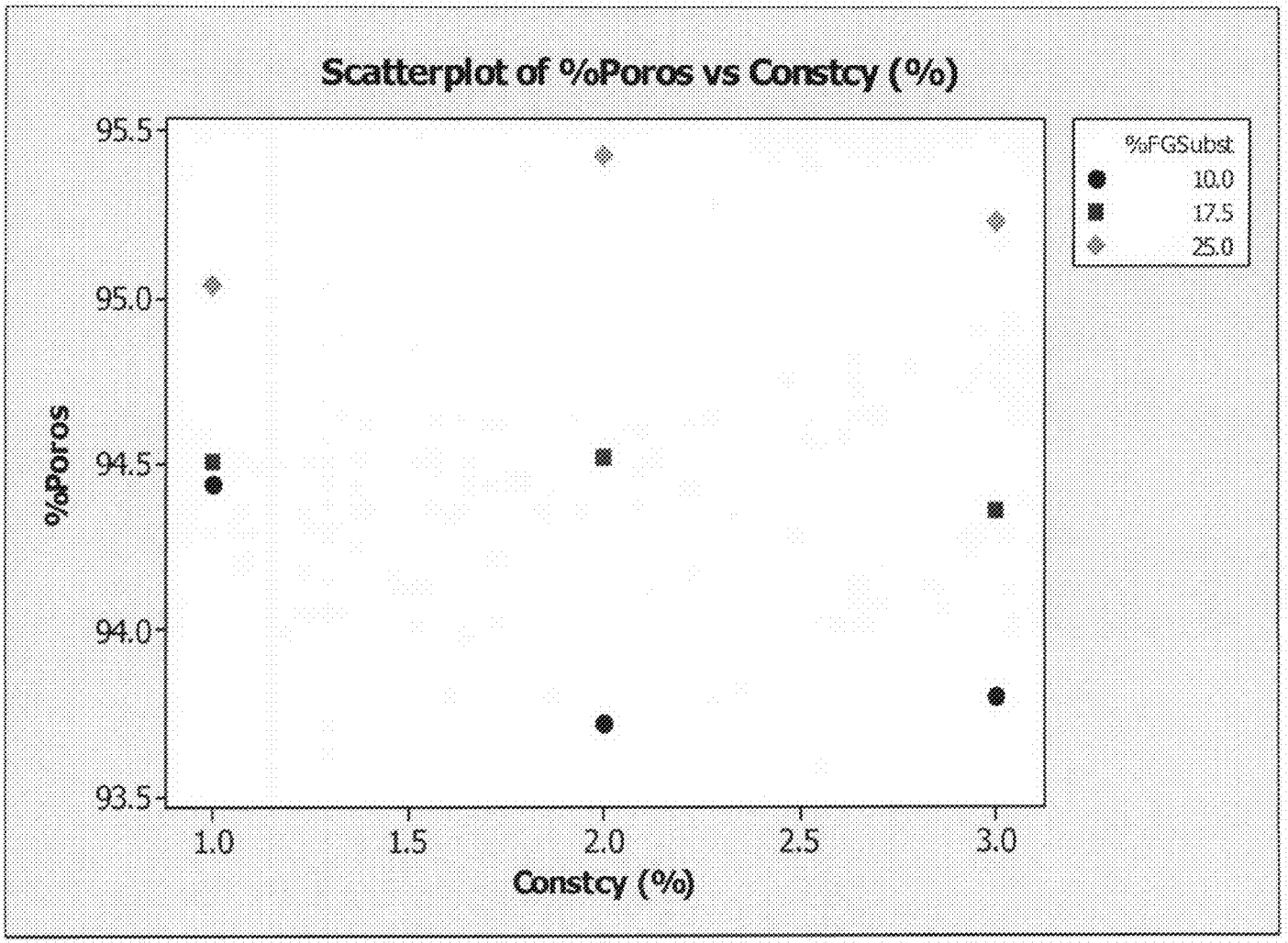
FIG. 7 is a chart illustrating the impact of spun fiber substitution and dispersion consistency on porosity.
Figure 8:
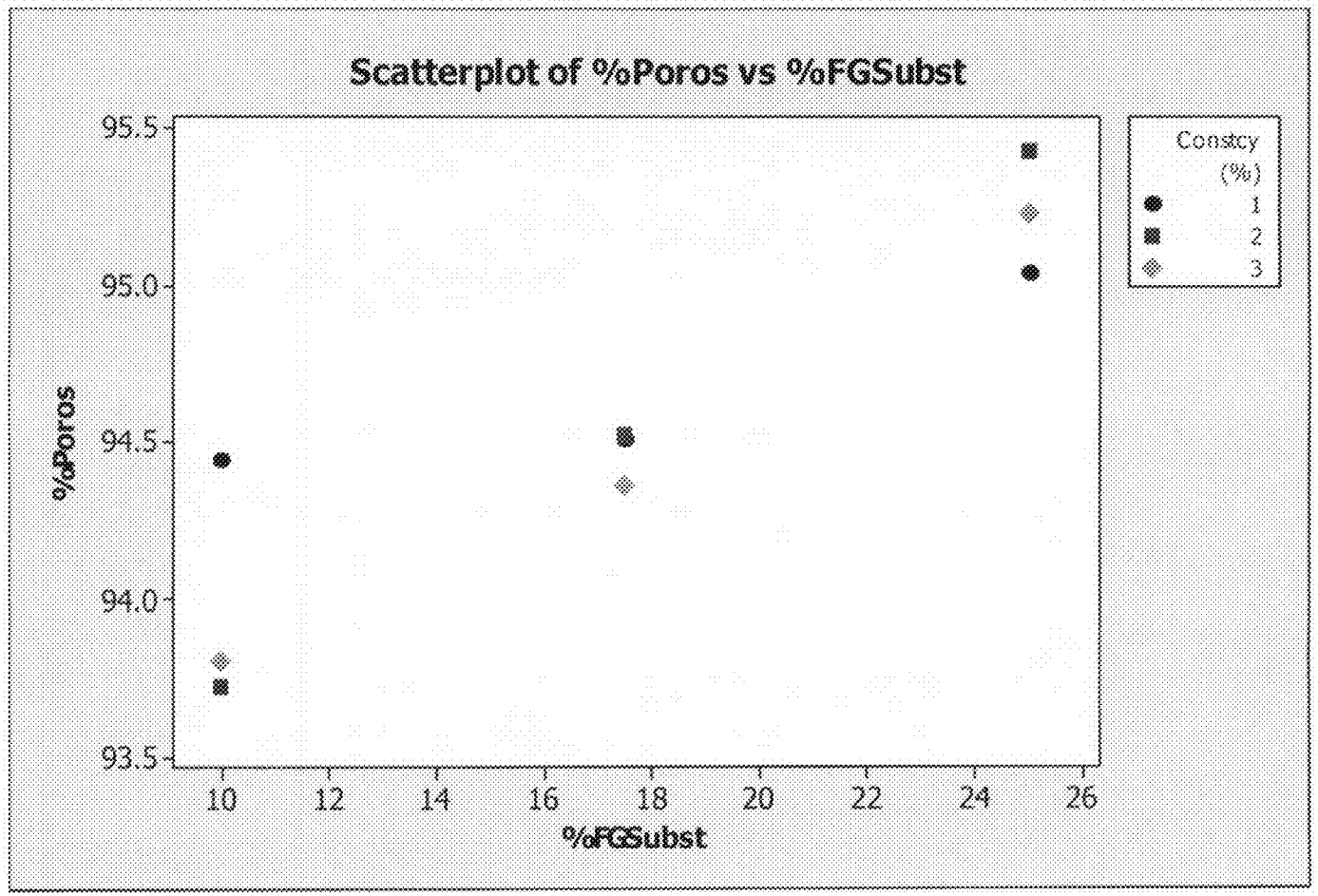
FIG. 8 is another chart illustrating the impact of spun fiber substitution and dispersion consistency on porosity.
Figure 9:
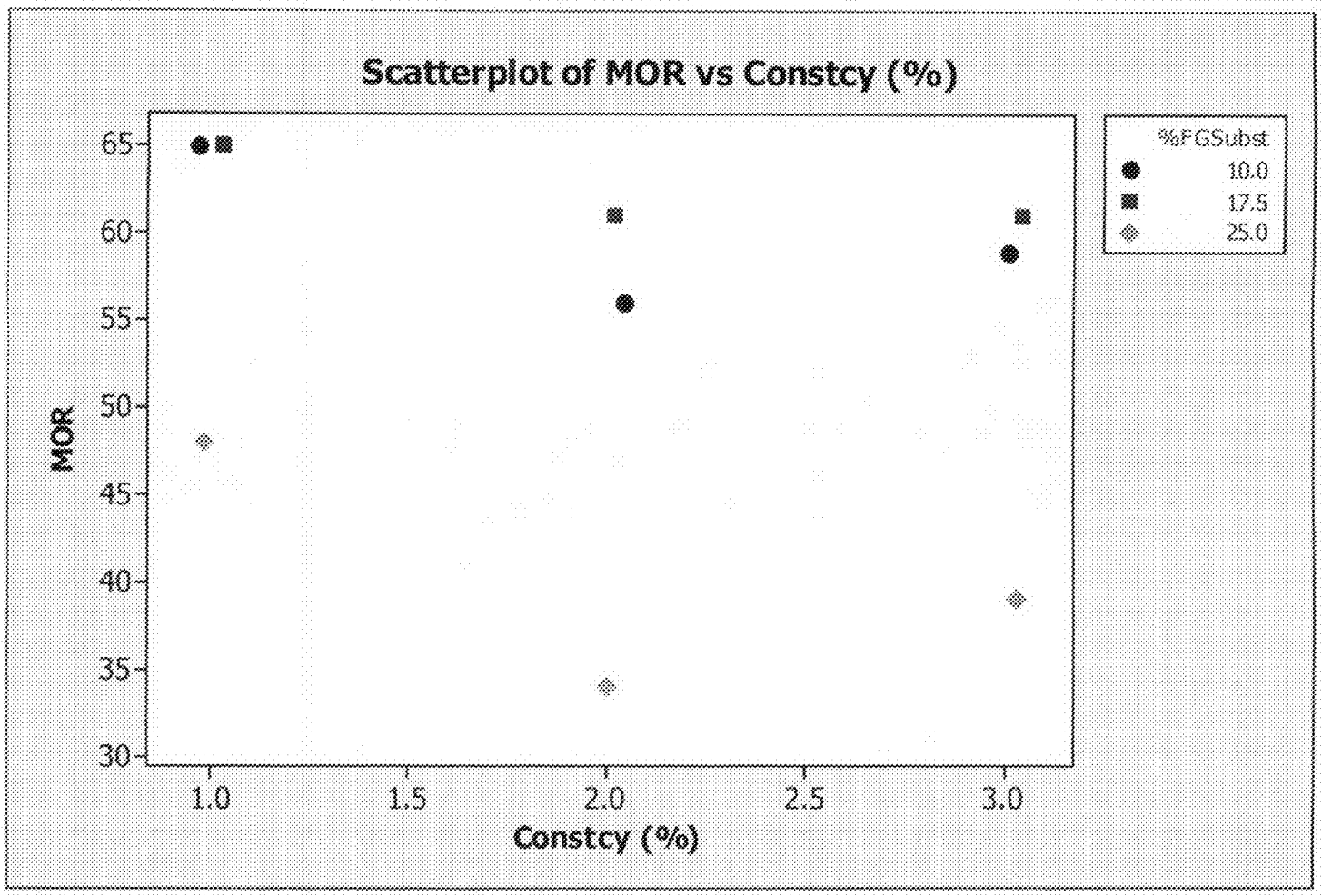
FIG. 9 is a chart illustrating the impact of spun fiber substitution and dispersion consistency on break-strength Modulus of Rupture (MOR).
Figure 10:
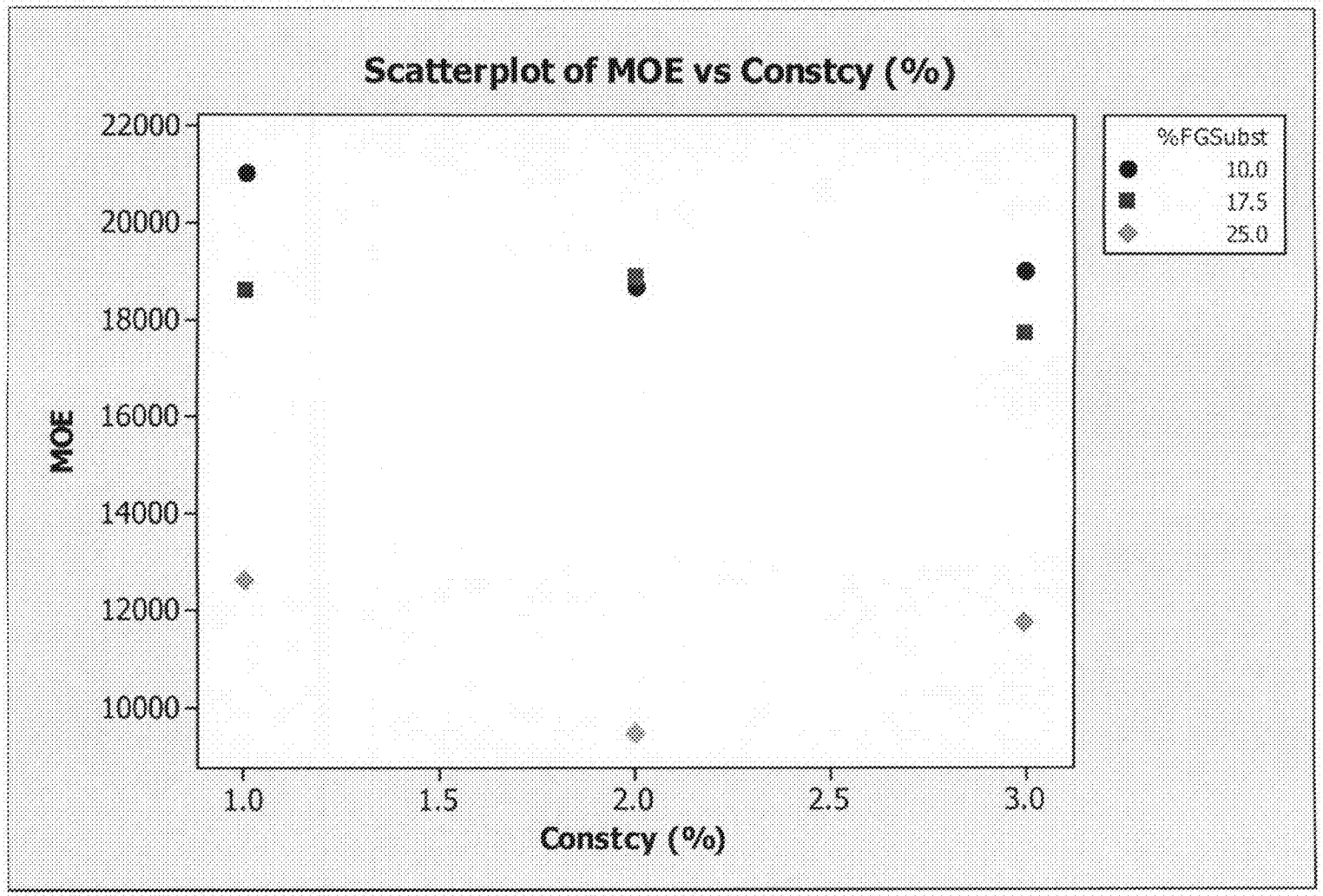
FIG. 10 is a chart illustrating the impact of spun fiber substitution and dispersion consistency on rigidity Modulus of Elasticity (MOE).

FIGS. 7-10 illustrate the results. FIG. 7 is a scatterplot of porosity versus dispersion consistency at 10, 17.5 and 25% fiberglass (rotary spun fiber) substitution. FIG. 8 is a scatterplot of Porosity versus fiberglass (rotary spun fiber) substitution at 1, 2 and 3% dispersion consistency. FIG. 9 is a scatterplot of rupture modulus (MOR), i.e. break-strength, versus dispersion consistency at 10, 17.5 and 25% fiberglass (rotary spun fiber) substitution. FIG. 10 is a scatterplot of elasticity modulus (MOE), i.e. rigidity, versus dispersion consistency at 10, 17.5 and 25% fiberglass (rotary spun fiber) substitution.

FIG. 7 illustrates that porosity increases with increasing fiberglass substitution. FIG. 8 illustrates that the effect of dispersion consistency on porosity is a little more subtle and depends to some extent on the amount of fiberglass in the formulation. More specifically, at 17.5% and 25% fiberglass substitution for wheel spun mineral wool, a 2% dispersion consistency is optimal. Whereas, at 10% fiberglass substitution, a 1% dispersion consistency yields a product with higher porosity. FIGS. 9 and 10 show that optimal strength and rigidity for the fiber-based substrate is achieved when the dispersion consistency is lowered and the fiberglass substitution percentage is increased.

It should be noted for purposes of comparison that incorporation of too high an amount of rotary spun fibers, i.e. a high rotary spun fiber substitution for wheel spun fibers at a high dispersion consistency, would render a highly viscous suspension which would be too viscous to yield a well formed product. More specifically, pumping and delivery of such suspension to the forming head-box would be difficult, with the suspension material jamming the pipes and pumps. The solids could be mixed in suspension with a high torque impeller until the fibers ball-up, i.e. modulate, and then be pumped to the wire, however, the resulting substrate would be higher in density and lower in porosity, and, thus, not meet the 0.80 NRC threshold. In addition, the wet-mat would be poorly felted with little integrity, resulting in a relatively weak flimsy product.

Wet-mats formed by the composition of the invention dry more rapidly and with less energy than traditional wet-formed mineral fiber formulations, by virtue of their high porosity and hydrophobic nature. As previously mentioned, conventional wet-formed ceiling panels with high mineral fiber content require ample cellulose paper fiber and/or perlite content to provide sufficient wet-web strength and rigidity for the product to flow through the board-making process. Perlite is the most common vehicle for rendering bulk in a traditional wet-formed mineral fiber ceiling panels. Wet perlite because of the fine integral cell pore structure and general hydrophilicity is notoriously difficult and slow to dry.

In contrast, the present invention requires no perlite or cellulose fiber to maintain bulk and prevent wet-mat folding during the production process. The rotary spun fibers, via their length, diameter and curled shape provide ample bulk and sufficient wet-web strength and rigidity. Additionally, due to the significant bulk achieved through the use of rotary spun fibers in the mix, a lower material basis weight is required to produce a given thickness. Therefore, for given moisture percentage, less water-load will be conveyed to the dryer, and in turn, the product will dry more quickly which effectively decreases manufacturing cost.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. An intermediate acoustical fiber-based product comprising a composition which includes rotary spun fibers and water, the composition having a dispersion consistency up to 3.5% by weight.

2. The intermediate product of claim 1, wherein aqueous slurry has a dispersion consistency of about 2.0% by weight or lower.

3. The intermediate product of claim 1, wherein said composition yields a substrate having an NRC value of at least 0.80.

4. The intermediate product of claim 1, wherein the composition includes a hinder which has no formaldehyde emitting reactive resin.

5. The intermediate product of claim 1, wherein the composition includes wheel spun fibers.

6. The intermediate product of claim 5, wherein the ratio of rotary spun fibers to wheel spun fibers is at least 0.13:1.

7. The intermediate product of claim 1, wherein a majority of the rotary spun fibers have a diameter of greater than 5 microns.

8. An acoustical fiber-based substrate comprising:

a blend of rotary spun fibers and wheel spun fibers, wherein the ratio of rotary spun fibers to wheel spun fibers is at least 0.13:1; and a binder which has no formaldehyde emitting reactive resin;

wherein the substrate exhibits an NRC value of at least 0.80.

9. The acoustical fiber-based substrate of claim 8, wherein the substrate has a porosity of about 93% or greater.

10. The acoustical fiber-based substrate of claim 8, wherein a majority of the rotary spun fibers have a diameter of greater than 5 microns.

* * * * *

UNITED STATES PATENT AND TRADEMARK OFFICE

CERTIFICATE OF CORRECTION

PATENT NO. : 8,025,769 B2
APPLICATION NO. : 12/231151
DATED : September 27, 2011
INVENTOR(S) : Wiker et al.

It is certified that error appears in the above-identified patent and that said Letters Patent is hereby corrected as shown below:

Col. 8 Claim 4, line 9, the word "hinder" should be -- binder --.

Signed and Sealed this
Thirty-first Day of January, 2012

David J. Kappos

David J. Kappos
*Director of the United States Patent and Trademark Office*